United States Patent [19]

Matsubara et al.

[11] Patent Number: 4,901,616

[45] Date of Patent: Feb. 20, 1990

[54] ELECTRONIC MUSICAL INSTRUMENT WITH DELAY TRIGGER FUNCTION

[75] Inventors: Akinori Matsubara; Takahashi Akutsu, both of Tokyo, Japan

[73] Assignee: Casio Computer Co., Ltd., Tokyo, Japan

[21] Appl. No.: 256,740

[22] Filed: Oct. 11, 1988

[30] Foreign Application Priority Data

Oct. 14, 1987 [JP] Japan ..... 62-259297
Oct. 14, 1987 [JP] Japan ..... 62-157055[U]
Oct. 14, 1987 [JP] Japan ..... 62-157056[U]

[51] Int. Cl.[4] ..... G10H 7/00
[52] U.S. Cl. ..... 84/1.03; 84/462
[58] Field of Search ..... 84/1.01, 1.03, 1.11–1.13, 84/1.19–1.23, 1.28, 115, 462, DIG. 29

[56] References Cited

U.S. PATENT DOCUMENTS 4,022,097 5/1977 Strangio ..... 84/1.03

OTHER PUBLICATIONS

Catalog sheets–Yamaha Digital Synthesizers, entitled "Portraits", Yamaha Corporation, Apr. 1988.
Manual for "V2" Digital Programmable Algorithm Synthesizer, Yamaha Corporation, 1988.

*Primary Examiner*—Stanley J. Witkowski
*Attorney, Agent, or Firm*—Frishauf, Holtz, Goodman & Woodward

[57] ABSTRACT

In playing a music, the present electronic musical instrument stores a code for a performance event and data of generation time length until a presently-specified performance event is regenerated, in a sequencer memory. For each playback access to this sequencer memory, a performance event is excecuted upon elapse of a time corresponding to the generation time interval data of the performance event read out from the memory. For instance, a musical tone which is generated by depression of a key on a keyboard, is generated again with the designated pitch after a given time.

9 Claims, 12 Drawing Sheets

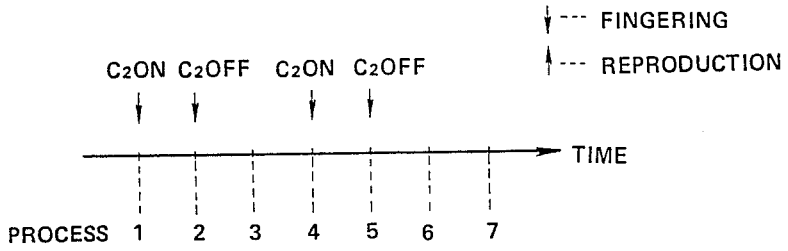
FIG. 7
FIG. 8(A) PROCESS 1
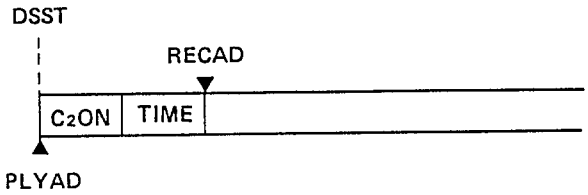
FIG. 8(B) PROCESS 2
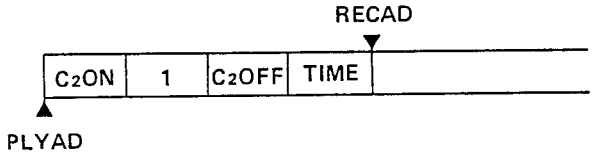
FIG. 8(C) PROCESS 4
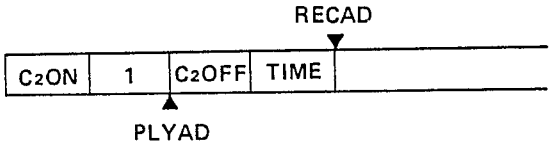
FIG. 8(D) PROCESS 5
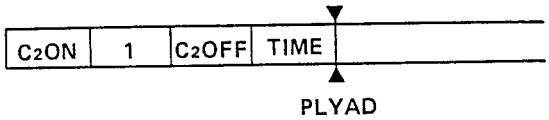
FIG. 8(E) PROCESS 6
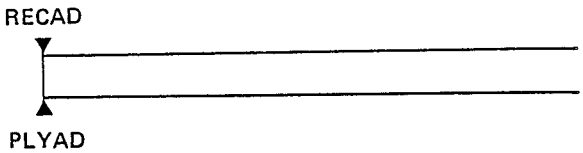

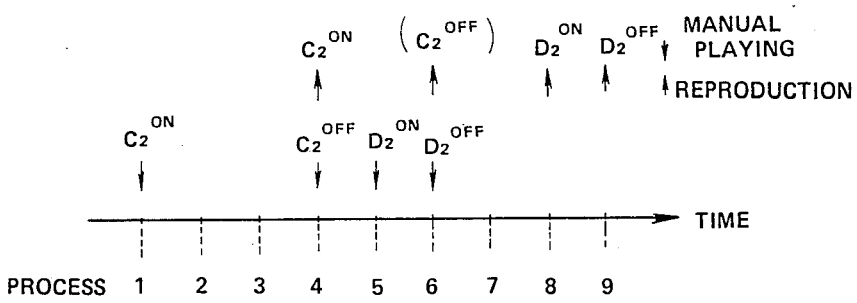
FIG. 18
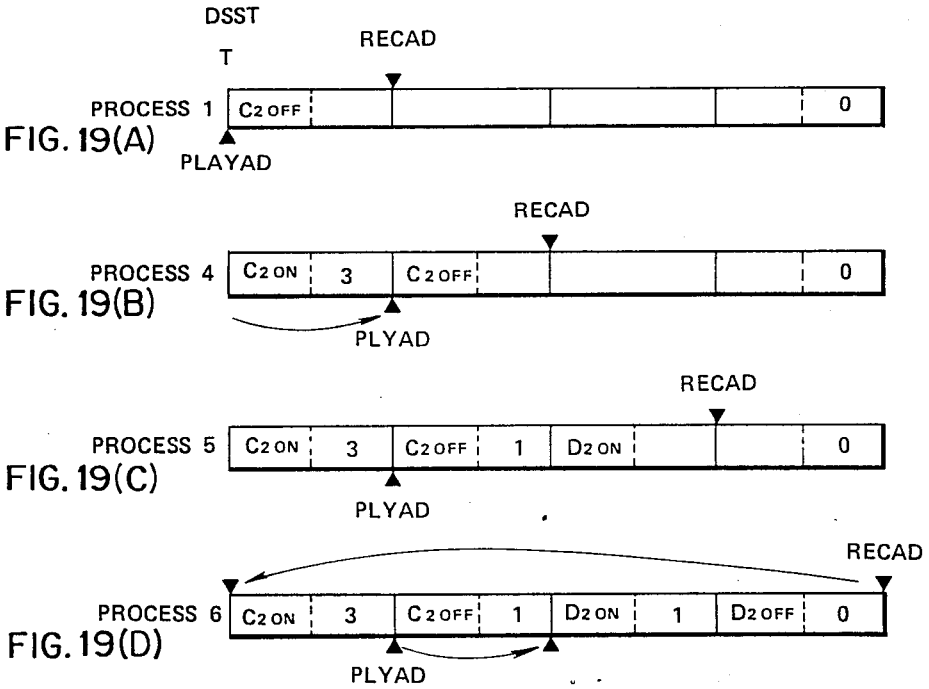
FIG. 19(A)
FIG. 19(B)
FIG. 19(C)
FIG. 19(D)

ELECTRONIC MUSICAL INSTRUMENT WITH DELAY TRIGGER FUNCTION

BACKGROUND OF THE INVENTION

1. Field of the Invention

The present invention relates to an electronic musical instrument with a delay trigger function.

2. Description of the Related Art

There are known delay effect producing apparatuses which delay a direct sound to produce a delay effect. When notes C2, D2, E2 and F2 are triggered in the order as shown in FIG. 1, for example, such apparatuses produce the associated musical sounds of notes C2, D2, E2 and F2 and produce them again after a given delay time. This type of delay effect was realized at first by an analog delay device, such as a BBD (bucket brigade device), and was realized later by such hardware as a signal processor as a exclusive use for digital delay.

Recently, in order to improve the cost performance, there appeared a system that produces a delay effect under the program control of a CPU in place of the above exclusive hardware. Synthesizer "V2" (YAMAHA product) is an example of such system, and its structure is illustrated in FIGS. 2 and 3. In this example, a sound source has a 16-polyphonic function (16 sound channels), eight channels for real time sounding and the remaining eight channels for delayed sounding. FIG. 2 illustrates key code assign registers used by a key assign section of the CPU for sound assignment, and at their address corresponding to each sound channel is written a key code which uses that sound channel. Key codes for real time sounding are stored in registers ch0 to ch7, and key codes for delayed sounding in registers ch8 to ch15. When key codes C2, D2, E2 and F2 are inputted in the named order, for example, the CPU sequentially stores key code C2 in register ch0, key code D2 in register ch1, key code E2 in register ch2 and key code F2 in register ch3 and generates their musical tones through the associated channels. Further, in generating the musical tones, the CPU sets initial delay times in those sections of a delay time counter TM which are associated with the tones. The set values in delay time counter TM are decremented every given period, and when each count value becomes zero, a key code (e.g., C2) is latched from the associated sound channel register (ch0 in this case) in the real time channel key code assign register RA and is transferred to the associated sound channel register (ch8 for ch0) in delay channel key code assign register DA. Then, this sound channel is driven to generate the associated musical tone.

As the above arrangement is realized by adding the delay function to the key assign function of the CPU, no exclusive hardware is necessary.

With the above arrangement, however, when the number of keys depressed within a delay time exceeds an allowable polyphonic number, it is not possible to generate delayed sounds for those exceeded keys. For instance, ten tones, C2, D2, E2, F2, G2, A2, B2, C3, D3 and E3, are generated in the named order, the last two key codes D3 and E3 will be latched in key code assign registers ch0 and ch1 according to the truncate logic and ch0 and ch1 of delay time counter TM are initialized again. This clears the previous data in registers ch0 and ch1, so that C2 and D2 would never be generated.

SUMMARY OF THE INVENTION

Accordingly, it is an object of this invention to provide an electronic musical instrument with a delay trigger function, which can give the desired delay to every performance event to ensure tone control irrespective of the number of performance events per one delay time.

It is another object to provide an electronic musical instrument which ensures a plurality of delay triggerings with a small memory capacity.

It is a still another object to provide an electronic musical instrument with a delay trigger function, which can provide delayed outputs even with respect to a performance that causes an overflow of a sequencer memory.

This invention is devised with a particular attention to simultaneous execution of recording and playback operations of a real time sequencer in order to provide the desired delay between the recording timing and playback timing, and an electronic musical instrument according to this aspect comprises:

sequence record processing means including recording address pointer means, which is incremented upon each recording access to a sequencer memory, and recording timer means for measuring performance event generation time interval data of a performance event in a performance input apparatus, the sequence record processing means for, upon generation of a performance event, recording a code of the performance event and performance event generation time interval data indicated by the recording timer means in that area in the sequencer memory which is indicated by the recording address pointer means; and sequence playback processing means including playback address pointer means, which is incremented upon each playback access to the sequencer memory, and playback timer means, which is initialized to have a value delayed by a given time from a value of the recording timer means, the sequence playback processing means for executing an associated performance event when the performance event generation time interval data indicated by the playback address pointer means coincides with a content of the playback timer means.

This invention is also devised with a particular attention to sharing one sequencer memory for recording and multi-delay playback purposes, and an electronic musical instrument according to this aspect comprises:

sequence record processing means including recording address pointer means, which is incremented upon each recording access to a sequencer memory, and recording timer means for measuring performance event generation time interval data of a performance event in a performance input apparatus, the sequence record processing means for, upon generation of a performance event from the performance input apparatus, recording a code of the performance event and a content of the recording timer means in that address of the sequencer memory which is indicated by the recording address pointer means; and multi-delay playback processing means including a plurality of playback timer means and a plurality of playback address pointer means in one to one association with said plurality of playback timer means in order to reproduce data recorded in the sequencer memory with a plurality of different delay times, the multi-delay playback processing means for initializing the individual playback timer means to have mutually different delay times, comparing performance event generation time interval data read out by each playback address pointer means with a content of the associated playback timer means, and executing an associated performance event and incrementing the associated playback address pointer means when the comparison results in a data coincidence.

An electronic musical instrument according to another aspect of this invention comprises:

sequence record processing means including recording address pointer means, which is incremented upon each recording access to the sequencer memory, and recording timer means for measuring a performance event generation time, the sequence record processing means for, upon generation of a performance event, recording a code of the performance event and a measured value of the recording timer means at that address in the sequencer memory which is indicated by the recording address pointer means;

delay playback processing means including playback address pointer means, which is incremented upon each playback access to the sequencer memory, and playback timer means, which is initialized to have a value delayed by a given time from a value of the recording timer means, the delay playback processing means for executing an associated performance event when arrival of a performance event generation time read out by the playback address pointer means is detected by the playback timer means; and control means for controlling the recording address pointer means and the playback address pointer means in such a way that when an address indicated by each of the recording and playback address pointer means exceeds an end address of the sequencer memory as a result of their increment, a value of that address pointer means is set back to head address of the sequencer memory.

BRIEF DESCRIPTION OF THE DRAWINGS

FIG. 7 is a time chart exemplifying a performance sequence and playback sequence;

FIGS. 8(A)–8(E) are diagrams illustrating the status of a sequencer memory SQ and positions of a recording address pointer RECAD and playback address pointer PLYAD at each processing timing;

FIG. 18 is a time chart illustrating examples of a performance sequence and a playback sequence; and FIGS. 19(A)–19(D) are diagrams illustrating the status of a sequencer memory and positions of recording and playback address pointers in each processing stage.

DETAILED DESCRIPTION OF THE PREFERRED EMBODIMENTS

Figure 1:
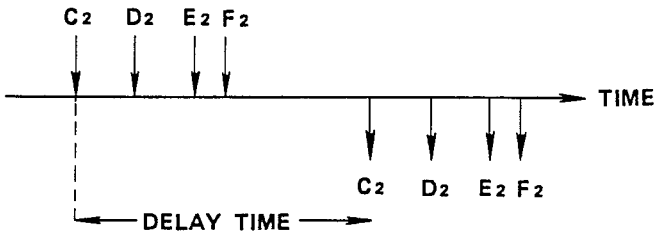
FIG. 1 is a time chart illustrating an example of a performance/playback sequence used for explaining prior art.
Figure 2:
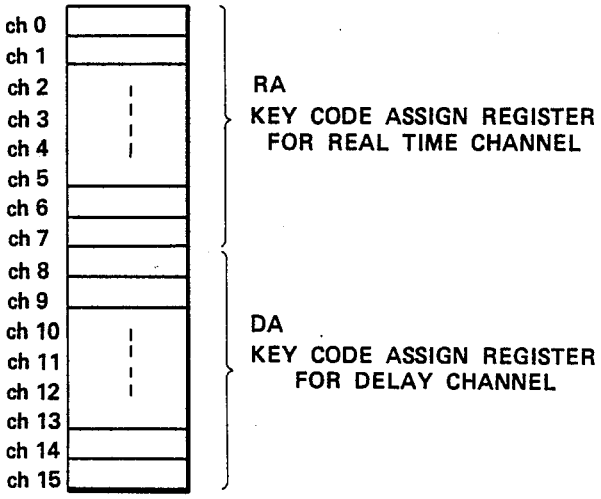
FIG. 2 is a diagram illustrating a real time/delay division type key code assign register used in prior art.
Figure 3:
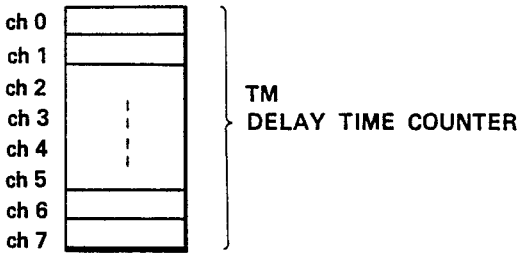
FIG. 3 is a diagram illustrating a delay time counter for each channel used in prior art.
Figure 4:
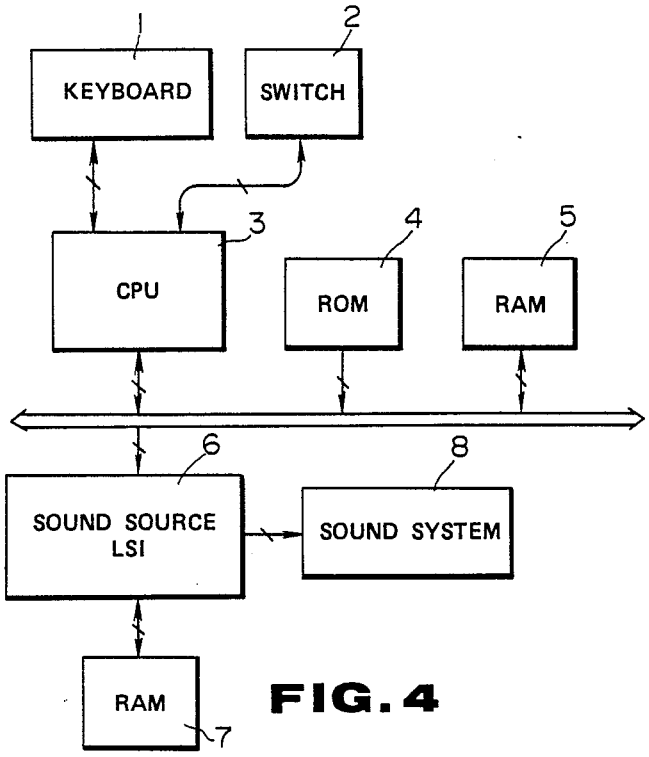
FIG. 4 a diagram illustrating the general arrangement of an electronic musical instrument according to the first embodiment of this invention.

FIG. 4 illustrates the general arrangement of an electronic musical instrument having the features of this invention. A CPU 3 moniters the depression/releasing of keys on a keyboard 1 and selection of a timbre, etc. through a switch 2 in accordance with a control program stored in a ROM 4. To control a sound source LSI 6, CPU 3 transfers the desired data stored in ROM 4 or RAM 5 to the sound source LSI 6 and sets the data in a RAM 7 in sound source LSI 6. Sound source LSI 6 uses RAM 7 as a computation buffer to synthesize musical tones. The synthesized tone is sent to a sound system 8 where it is converted into an audio signal.

Figure 5:
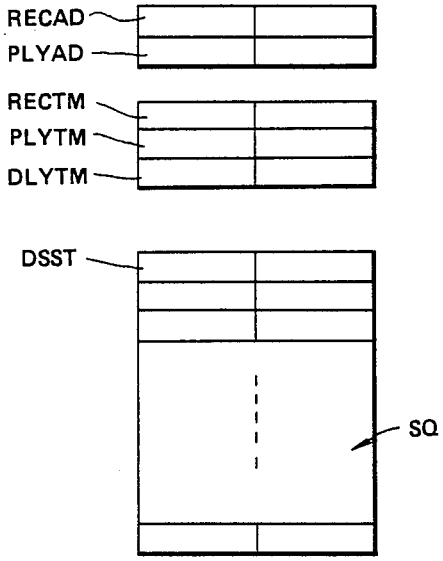
FIG. 5 a diagram illustrating various registers for sequence recording/playback in a RAM 5 shown in FIG. 4.

FIG. 5 illustrates those registers in RAM 5 which are involved in a delay function. In this figure, SQ is a sequencer memory in which performance data entered through keyboard 1 is stored together with time data in real time and from which the stored data is reproduced with a given delay. The head address of sequencer memory SQ is indicated by DSST. RECAD is a recording address pointer which is used by sequence record processing means of CPU 3 and stores an address on sequencer memory SQ at which the next performance event is to be stored. PLYAD is a playback address pointer used by a sequence playback processing means of CPU 3, and its content represents an address for the next performance event to be reproduced from sequencer memory SQ. RECTM is a recording time counter used by the sequence record processing means. This counter RECTM measures the time interval between performance events. More specifically, upon generation of a performance event through keyboard 1, the value of recording time counter RECTM at that time is written as generation time data of that performance event in sequencer memory SQ, and counter RECTM is then reset and thereafter performs a count-up operation to measure the time until generation of the next performance event through keyboard 1. Since the generation time data of the first performance event can be considered to be zero, nothing is written in sequencer memory SQ.

PLYTM is a playback time counter used by the sequence playback processing means. In order to provide a given time difference between the recording process by the sequence record processing means and the playback process by the sequence playback processing means, playback time counter PLYTM is initialized to have a delay value set in a delay set register DLYTM. As will be described later, counter PLYTM downcounts, and playback timing for a performance event is when the count value becomes zero. Therefore, the value of register DLYTM set as the initial value in recording time counter RECTM is a hold time until the first performance event is executed, and the countdown operation of counter PLYTM starts when the record processing means executes real time recording of the first performance event. The value of playback address pointer PLYAD is compared with the value of recording address pointer RECAD to detect that no performance event to be executed by the playback processing means is left. When these values coincide with each other, no performance event to be reproduced by the playback processing means remains. When the coincidence is detected, therefore, the values of playback address pointer PLYAD and recording address pointer RECAD are set back to the head address of sequencer memory SQ. This can reduce the necessary memory capacity of sequencer memory SQ. In order for a new performance event to start at time zero, a delay value of register DLYTM is set in playback time counter PLYTM as recording time counter RECTM is initialized to be zero.

Figure 6:
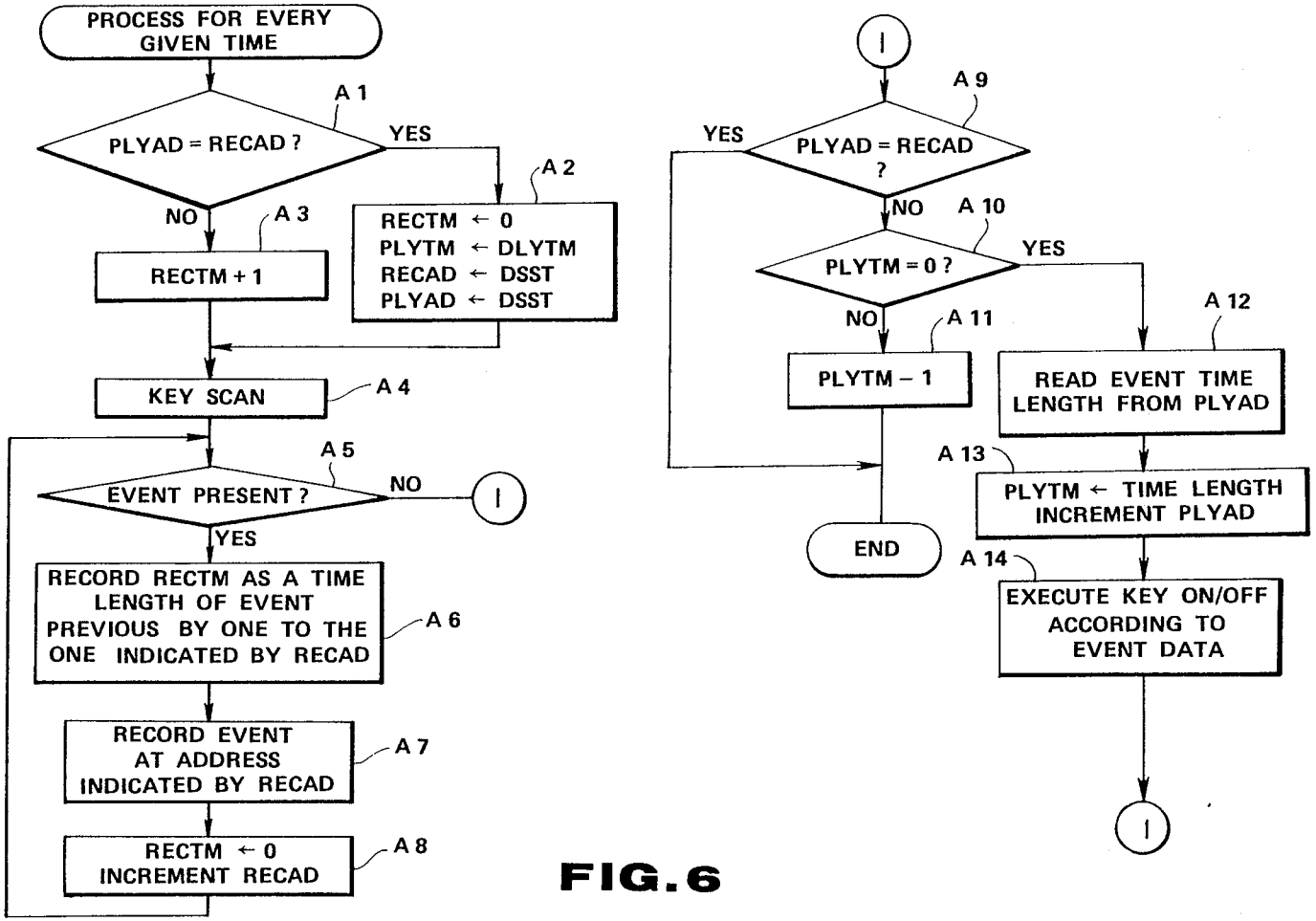
FIG. 6 is a flowchart for a sequence recording/delay playback which is executed by a CPU 3.

FIG. 6 illustrates a flowchart for a recording/delay playback process that CPU 3 executes. Assume that, at the time power is turned on, the values of both of playback and recording address pointers PLYAD and RECAD are initialized to the head address DSST of sequencer memory SQ and that the value of register DLYTM is "3."

For every given time, the process enters the illustrated flow and PLYAD and RECAD are compared with each other in step A1. Coincidence is detected when nothing is written yet in sequencer memory SQ or no performance event to be executed by the playback processing means is left. Upon occurrence of the coincidence, step A2 is executed where recording time counter RECTM is set to "0", playback time counter PLYTM to "3" (value of register DLYTM) and recording and playback address pointers RECAD and PLYAD to the head address "DSST". If no event is detected in step A5 after performing key-scanning in step A4, PLYAD=RECAD in step A9 and CPU 3 leaves the flow. The above process is executed for every given time.

FIG. 7 illustrates examples of performance and playback. C2 is ON at the timing of process 1 and is OFF at the timing of process 2. FIGS. 8(A)–8(E) illustrate the status of sequencer memory SQ and the positions of recording and playback address pointers RECAD and PLYAD in each process stage.

To begin with, in process 1 in FIG. 8(A), since PLYAD=RECAD (=DSST), counters RECTM and PLYTM are set to be RECTM=0 and PLYTM=3 in step A2 and an even that C2 is ON is detected through key scanning (see steps A4 and A5). Consequently, a code indicating the event of C2 being ON is written at the address indicated by the recording address pointer in step A7. In the next step A8, counter RECTM is reset to be zero and recording address pointer RECAD is incremented to indicate the position where the next performance event is to be recorded. In this case, the process in step A6 need not be considered. Even if step A6 should be executed, the storage location for a time length is outside the sequencer memory SQ and the time length is not considered to have been written in sequencer memory SQ. CPU 3 then advances to the branch (1) and PLYAD does not coincide with RECAD in step A9 as a result of the increment of RECAD in step A8. As PLYTM is set with "3", PLYTM=0 is not satisfied in step A10 and PLYTM becomes "2" in step A11.

In the next process 2 in FIG. 8(B), since PLYAD=-RECAD in A1 is not satisfied, recording time counter RECTM is incremented by one (RECTM=1). Through key scanning in A4, an event of C2 being OFF is detected, which results in presence of an event in step A5. Consequently, the value "1" of RECTM is stored in a storage section for time data of the even previous by one to the position of RECAD as the time length between the ON event (previous event) of C2 and the OFF event (present event) of C2 (see step A6). Further, a code for the C2-OFF event is written at the address indicated by RECAD (step A7) and the initialization of RECTM and increment of RECAD are executed (step A8) as per process 1. Then, CPU 3 advances to the branch (1) and PLYTM is decremented by one to be "1" as per process 1 (steps A9, A10 and A11). In process 3, CPU 3 advances to the branch (1) after RECTM becomes "1" due to the increment RECTM+1 in step A3, and PLYTM becomes "0" due to the decrement PLYTM - 1 in step A11.

In the next process 4 in FIG. 8(C), CPU 3 advances to the branch (1) after RECTM becomes "2" due to the increment RECTM +1, and reads out the time length of "1" and the C2-0N event from PLYAD (step A12) as PLYTM=0 is detected in step A10. And, "1" indicating the time until the C2-OFF event is set in PLYTM and PLYAD is incremented (step A13). Finally, the C2-ON event is executed with respect to sound source LSI 6.

In the subsequent process 5 in FIG. 8(D), CPU 3 advances to the branch (1) after RECTM becomes "2" and executes the C2-OFF event as per process 4. As a result of this process 5, the position of PLYAD reaches the position of RECAD. Since RECAD represents a recording address of the next performance event to be generated through keyboard 1, PLYAD=RECAD being satisfied means that there remains no performance event to be reproduced.

In process 6 in FIG. 8(E), PLYAD=RECAD is detected in step A1, the aforementioned initialization A2 is executed and PLYAD and RECAD are set back to the head address DSST of sequencer memory SQ.

Referring to the flowchart of FIG. 6, it should be understood that playback time counter PLYTM is fixed to a given delay value DLYTM during an interval in which the playback address pointer equals the recording address pointer (PLYAD=RECAD) The condition PLYAD=RECAD will not be satisfied if a performance event occurs. Occurrence of a performance event causes PLYAD≠RECAD, and playback time counter PLYTM enters the decrement mode from that point of time. Therefore, counter PLYTM becomes zero upon elapse of a given delay after the occurrence of the performance event. At this time, this performance event is reproduced.

It is also the occurrence of a performance event that is a condition for starting the operation of recording time counter RECTM set to zero, in an increment mode while PLYAD=RECAD. Since PLYAD≠RECAD from the next processing cycle, the count value is incremented to measure the time till the occurrence of the next performance event, and upon every occurrence of a performance event, the count value is written in the sequencer memory as event time data and is cleared to be zero to measure the time until the next event occurs. Therefore, the playback processing means, which executes the first performance event with a given delay time from the actual time of occurrent of the event, can perform the playback of the actual performance sequence with a given time delay simply by measuring the time between events recorded in the sequencer memory by using the playback time counter and executing an associated event upon each elapse of a given time.

In the above manner, the performance sequence can be reproduced with a given time delay from the actual timing. Although FIG. 6 does not illustrates a real time tone control, this control can be realized by performing a tone control of the sound source in accordance with an event detected through the key scanning.

According to the first embodiment, in order to realize four types of delay triggerings, four sequencer memories are required. For instance, given that 1 bit is required for a key ON/OFF discrimination, 7 bits for pitch data, 7 bits for velocity data and 8 bits for time data, the amount of the necessary recording data for a single key-ON is about 3 bytes. In other words, 6 bytes are necessary for depression and release of a key for one tone. Let us consider the case where a 4 polyphonic backing is played with a sixteenth note for one bar. With 384 bytes per track, that would amount to about 1.5 KB for 4 tracks. In this respect, it is desirable to provide a multi-delay trigger technique for permit efficient use of the memory capacity, and such technique is realized in the second embodiment which will be described below.

Figure 9:
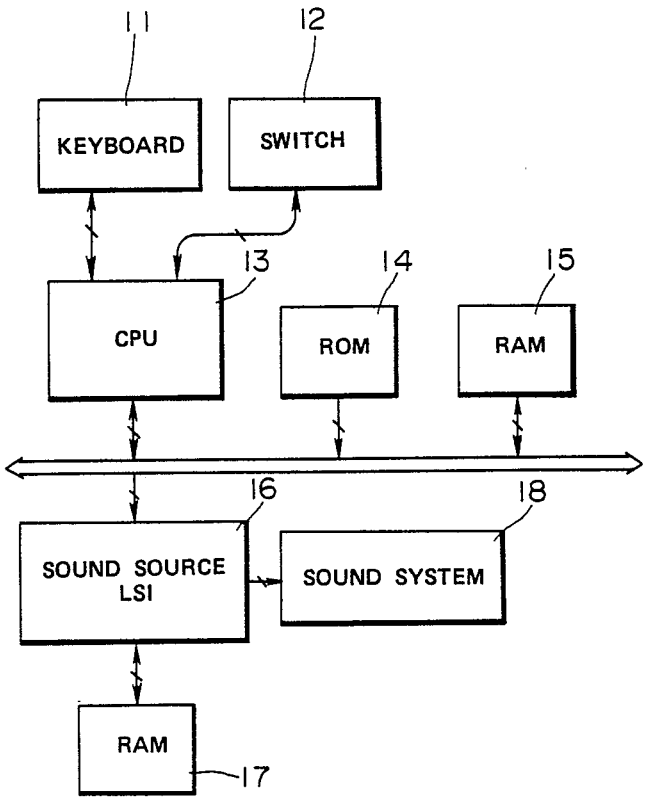
FIG. 9 is a diagram illustrating the general arrangement of an electronic musical instrument according to the second embodiment.

FIG. 9 illustrates the general arrangement of an electronic musical instrument for explaining the second embodiment. A CPU 13 monitors the depression/-releasing of keys on a keyboard 11 and selection of a timbre, etc. through a switch 12 in accordance with a control program stored in a ROM 14. To control a sound source LSI 16, CPU 13 transfers the desired data stored in ROM 14 or RAM 15 to the sound source LSI 16 and sets the data in a RAM 17 in sound source LSI 16. Sound source LSI 16 uses RAM 17 as a computation buffer to synthesize musical tones. The synthesized tone is sent to a sound system 18 where it is converted into an audio signal.

Figure 10:
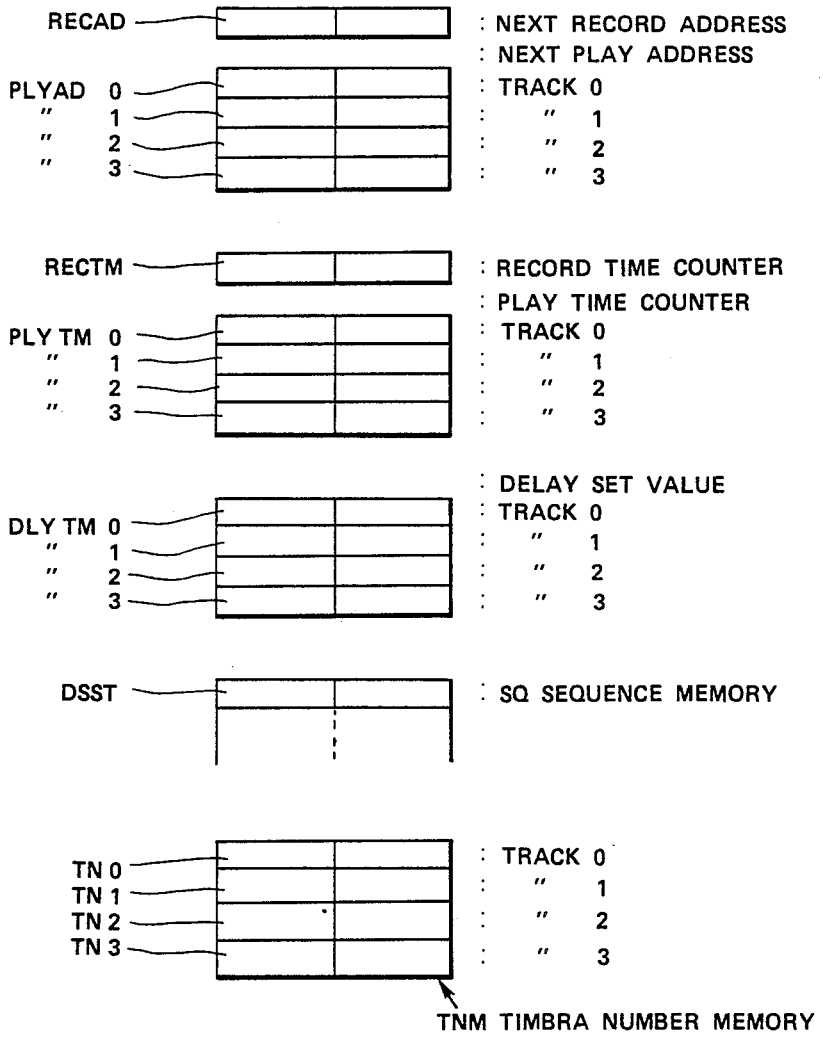
FIG. 10 is a diagram illustrating various registers used in sequence recording/multi-delay playback.

FIG. 10 illustrates those registers in RAM 15 which are involved in a delay function. In this figure, SQ is a sequencer memory in which a performance sequence is written in real time and from which it is reproduced with multi-delays. DSST is the head address of sequencer memory SQ. Recording registers include a recording address pointer RECAD for storing the next record address and a recording time counter RECTM for measuring the time between performance events. Because of 4 tracks for playback, there are four pointers, timers and delay registers. More specifically, PLYAD0 to PLYAD3 are playback address pointers for tracks 0–4 in which addresses of the next performance events to be reproduced are located. PLYTM0 to PLYTM3 are recording time counters for tracks 0–4 in which the values of delay register DLYTM for tracks 0–4 are respectively set as their initial values. The bottom registers in FIG. 10 are a timbre number memory TNM for the individual tracks, and individual registers TN0–TN3 store data of playback timbres for tracks 0–3.

Figure 11:
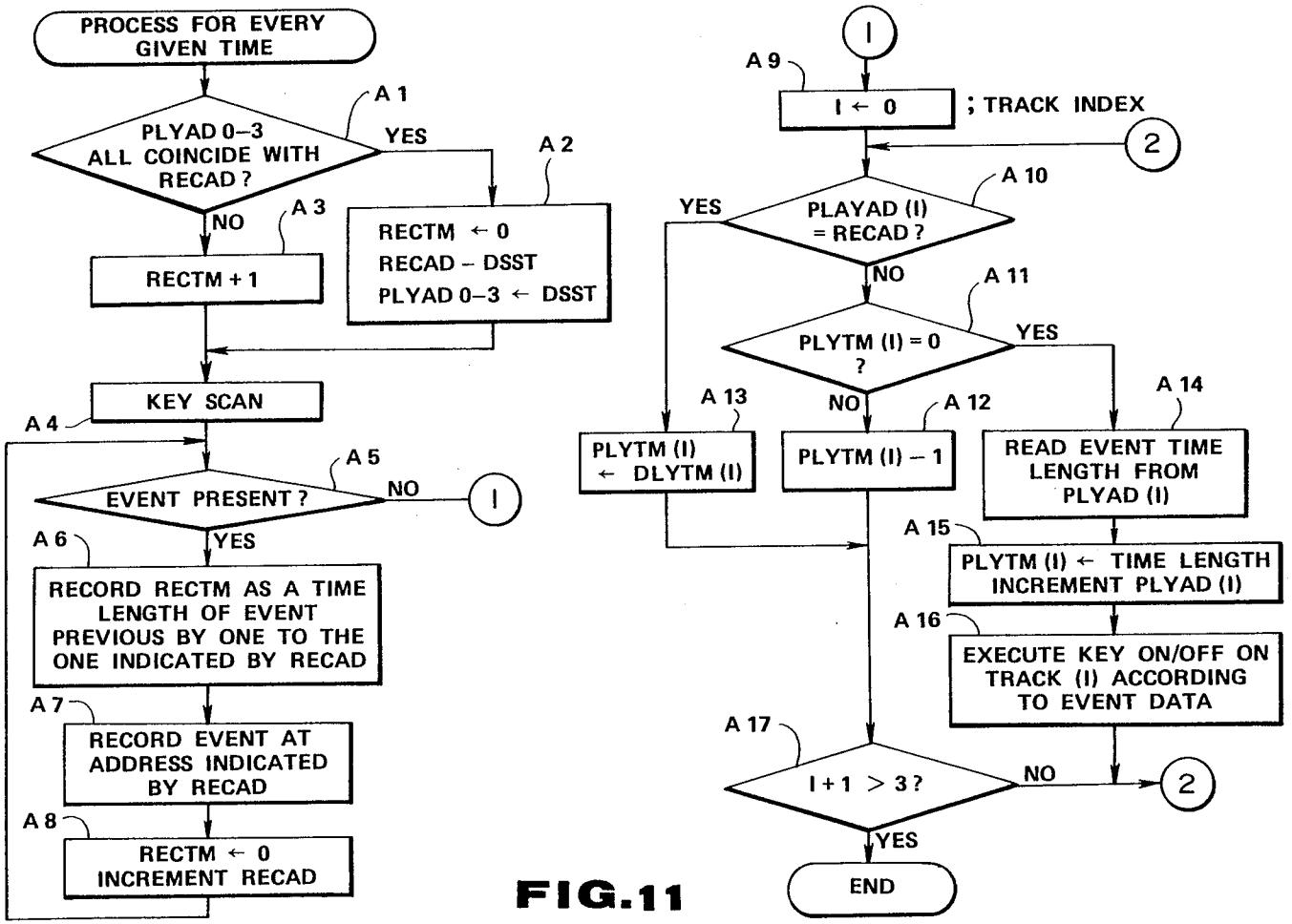
FIG. 11 is a flowchart for a sequence recording/multi-delay sequence playback which is executed by a CPU.

FIG. 11 illustrates the flowchart for a recording/multi-delay playback CPU 13 performs. CPU 13 executes the illustrated flow for a given time. As should be understood from FIG. 11, when PLYAD0 to PLYAD3 all coincide with RECAD, it is either prior to recording or no performance event remaining which should be reproduced by the playback processing means. While this condition is satisfied, RETCM is fixed to zero and PLYAD0 to PLYAD3 and RECAD are fixed to the head address DSST of sequencer memory SQ. Upon occurrence of the first performance event, RECAD is incremented so that the above condition will not be satisfied any more. Accordingly, after recording the first performance event, recording time counter RECTM is incremented until the next performance event occurs, measures the time between the events, is cleared at the time of recording the present event, and is thereafter kept incremented. The sequence on the right side in FIG. 11 is associated with playback and "I" is a track number. The playback time counter for each track is fixed to the value of the delay register DSST for that track while PLYAD (I)=RECAD is satisfied, but will be kept decremented to zero when the condition is not met. The execution timing for the first performance event for track I is when PLYTM (I) for that track becomes zero from DLYTM. Therefore, the first performance event is executed with different timings for different tracks. In executing the event, the hold time between the performance event to be executed and the next performance event is read out from sequencer memory SQ, PLYTM (I) is set to this hold time and PLYAD (I) is incremented.

A more detailed description will be given of the second embodiment referring to a practical example. In the following description, let us assume that DLYTM0=0, DLYTM1=2, DLYTM=4 and DLYTM3=6. When power is turned on, initialization corresponding to step A2 is executed. When CPU 13 enters this flows prior to event recording, therefore, PLYAD0 to PLYAD3 are all equal to RECAD (the condition in step A1 satisfied) and the initialization is performed in step A2. As no key input has been made yet, CPU 13 goes to the branch (1) and delay time DLYTM (I) of each track is set in the playback time counter of that track in step A13.

Figure 12:
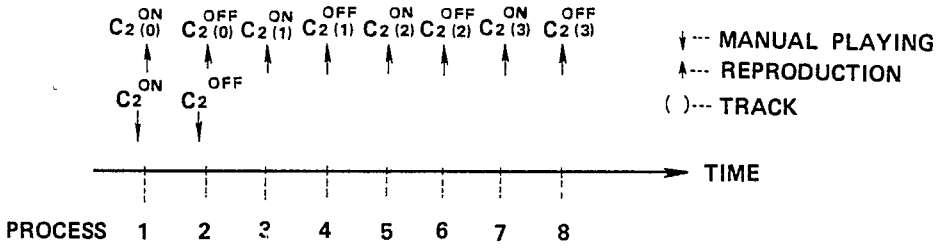
FIG. 12 is a time chart exemplifying a real time performance sequence and playback sequence.

FIG. 12 exemplifies a performance sequence and its playback sequence As C2 is ON in process 1, this even is detected in key scan step A4 and the recording process from step A5 to step A8 is executed in FIG. 11. That is, the event (C2 being ON) is written at the address indicated by RECAD, this RECAD is incremented, and RECTM is set to "0". Then, the flow advances to the branch (1). For track 0 (I=0), PLYAD (0)≠RECAD and PLYTM (0)=0, so that the event (C2 being ON) which should be executed is read out from PLYAD (0) and the event is executed with the timbre for track 0 (steps A10, A11, A14 to A16). Then, the flow advances to the branch (2). As PLYAD (0)=RECAD, DLYTM (0)=0 is set again in PLYTM (0) (steps A10 and A13). The above loop will be executed for other tracks (I=1 to 3). Since, for each track, PLYAD (1-3)≠RECAD and PLYTM (1-3)≠0, the playback time counters for the individual tracks 1–3 are decremented, rendering PLYTM (1)=1, PLYTM (2)=3, and PLYTM (3)=5 (steps A10, 11 and 12).

In process 2, RECTM is incremented by one to be "1" (steps A1 and A3). An event of C2 being OFF is detected and RECTM (=1) is written as the time between the C2-ON event to the C2-OFF event and the latter event is written in RECAD (steps A3 to A8). The flow then advances to the branch (1), and the event of C2 being OFF is immediately executed for track 0 and PLYTM (1–3) is decremented for tracks 1–3 as per process 1, thus rendering PLYTM (1)=0, PLYTM (2)=2 and PLYTM (3)=4.

In process 3, since PLYTM (1)=0 for track 1 after (1), the C2-ON event is executed. After PLYTM (1) becomes "1", the flow advances to the branch (2) and PLYTM (1) then becomes "0" (because the next performance event C2 being OFF is executed in the next process 4). The playback time counters for tracks 2 and 3 are decremented only by one, and PLYTM (2)=1 and PLYTM (3)=3.

Similarly, the C2-OFF event for track 1 is executed in process 4, and PLYTM (2) and PLYTM (3) respectively become "0" and "2".

In process 5, the C2-ON event for track 2 is executed, and PLYTM (2) and PLYTM (3) respectively become "0" and "1".

In process 6, the C2-OFF event for track 2 is executed, and PLYTM (3) becomes "0".

In process 7, the C2-ON event for track 3 is and PLYTM (3) becomes "0".

In process 8, the C2-OFF event for track 3 is executed.

As in the above manner, the real time recording of a performance sequence and the playback at a plurality of independent delay timings can be executed only with a single sequencer memory.

According to the first and second embodiments, when there remains no performance event that the playback processing means should reproduce, the playback address pointer means and recording address pointer means are set back to the head address of the sequencer memory.

However, the playback processing means completes the playback operation only when no performance event is present after the set delay time has been elapsed. As long as a performance event occurs within the delay time, the playback position never reaches the recording position, and an overflow occurs when the amount of data to be recorded exceeds the capacity of the sequencer memory, thus making it impossible to perform the recording/playback of subsequence performance events.

The third embodiment provides a technique for reducing the necessary capacity of the sequencer memory by setting the recording or playback address pointer means back to the head address of the sequencer memory when the address indicated by the address pointer means exceeds the end address of the sequencer memory.

Figure 13:
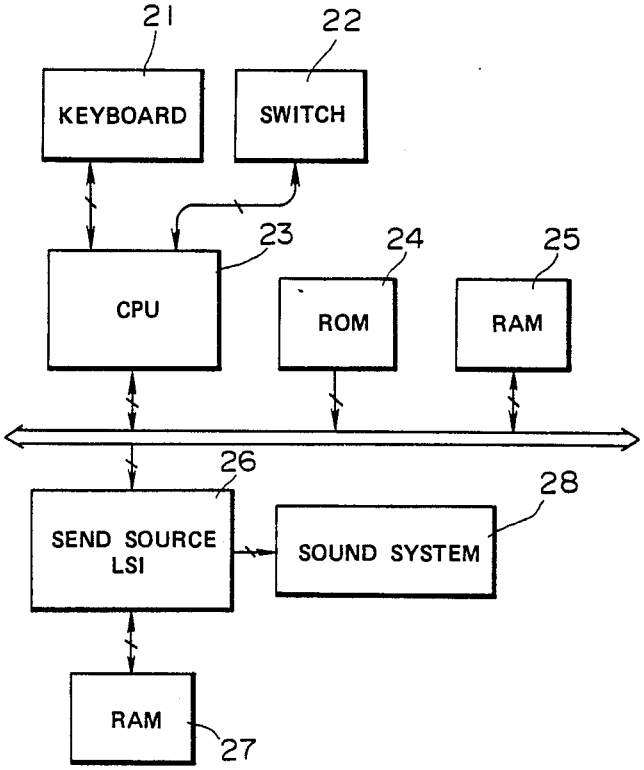
FIG. 13 is a diagram illustrating the general arrangement of an electronic musical instrument according to the third embodiment.

FIG. 13 illustrates the general arrangement of an electronic musical instrument for explaining the third embodiment. A CPU 23 monitors the depression/-releasing of keys on a keyboard 21 and selection of a timbre, etc. through a switch 22 in accordance with a control program stored in a ROM 24. To control a sound source LSI 26, CPU 23 transfers the desired data stored in ROM 24 or RAM 25 to the sound source LSI 26 and sets the data in a RAM 27 in sound source LSI 26. Sound source LSI 26 uses RAM 27 as a computation buffer to synthesize musical tones. The synthesized tone is sent to a sound system 28 where it is converted into an audio signal.

Figure 14:
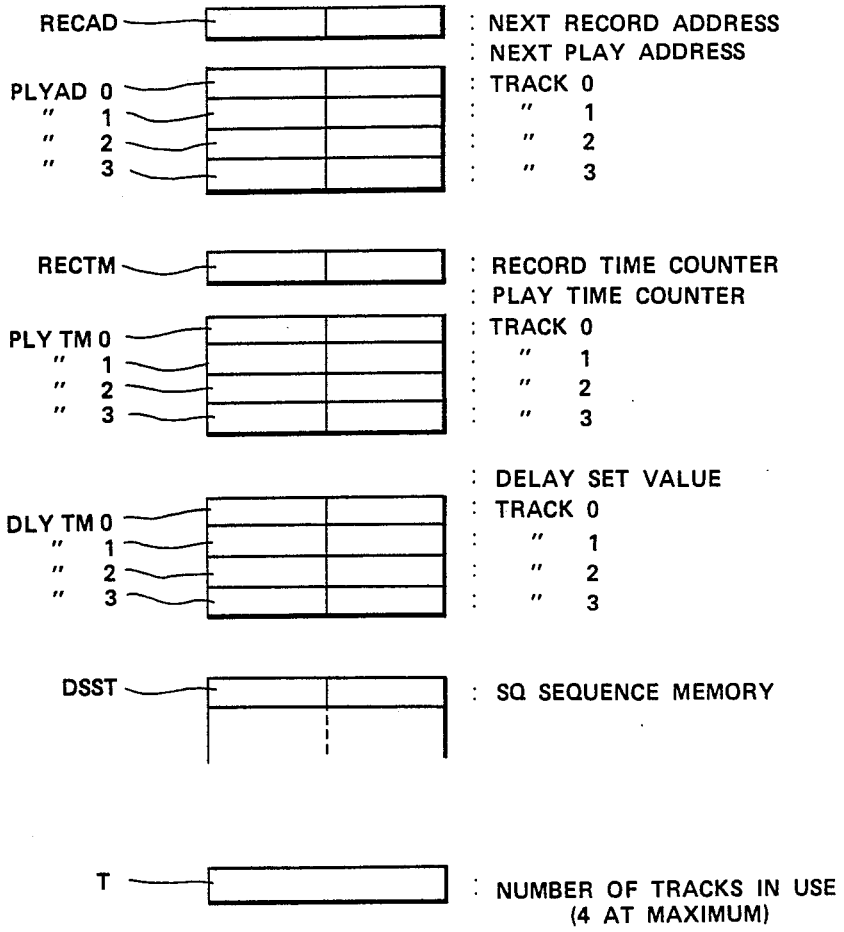
FIG. 14 is a diagram illustrating various registers involved in sequence recording/playback.

FIG. 14 illustrates those registers in RAM 25 which are involved in a delay function. In this figure, SQ is a sequencer memory in which performance data is written in real time and from which it is reproduced with multi-delays. DSST is the head address of sequencer memory SQ. Recording registers include a recording address pointer RECAD for storing the next record address and a recording time counter RECTM for measuring the time between performance events. Because of 4 tracks at maximum for playback, there are four pointers, timers and delay registers. More specifically, PLYAD0 to PLYAD3 are playback address pointers for tracks 0–4 in which addresses of the next performance events to be reproduced are located. PLYTM0 to PLYTM3 are recording time counters for tracks 0–4 in which the values of delay register DLYTM for tracks 0–4 are respectively set as their initial values. The bottom register in FIG. 14 stores data of the number of tracks in use.

Figure 15:
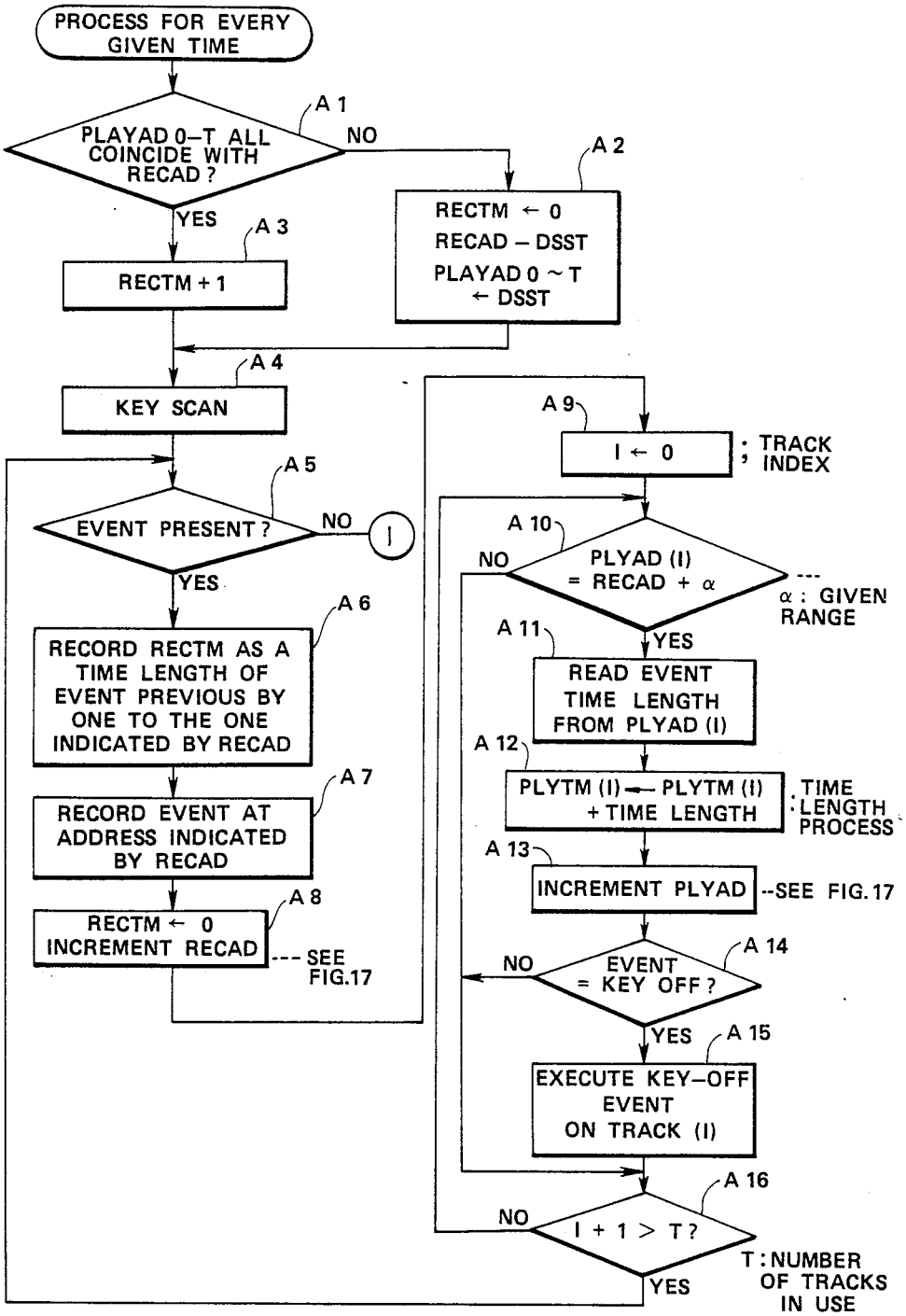
FIG. 15 is a flowchart for part of sequence recording/playback.
Figure 17:
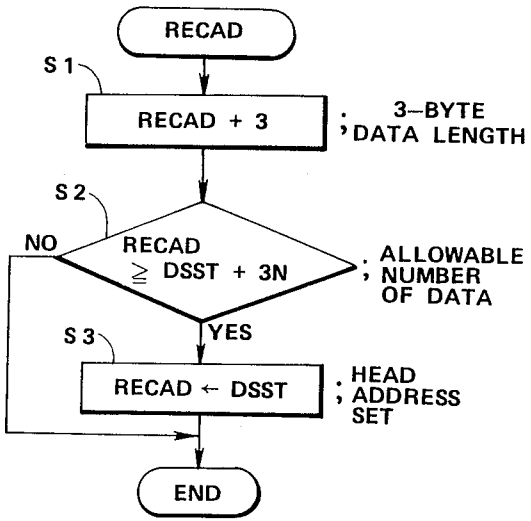
FIG. 17 is a flowchart for a updating process of a playback address pointer.
Figure 16:
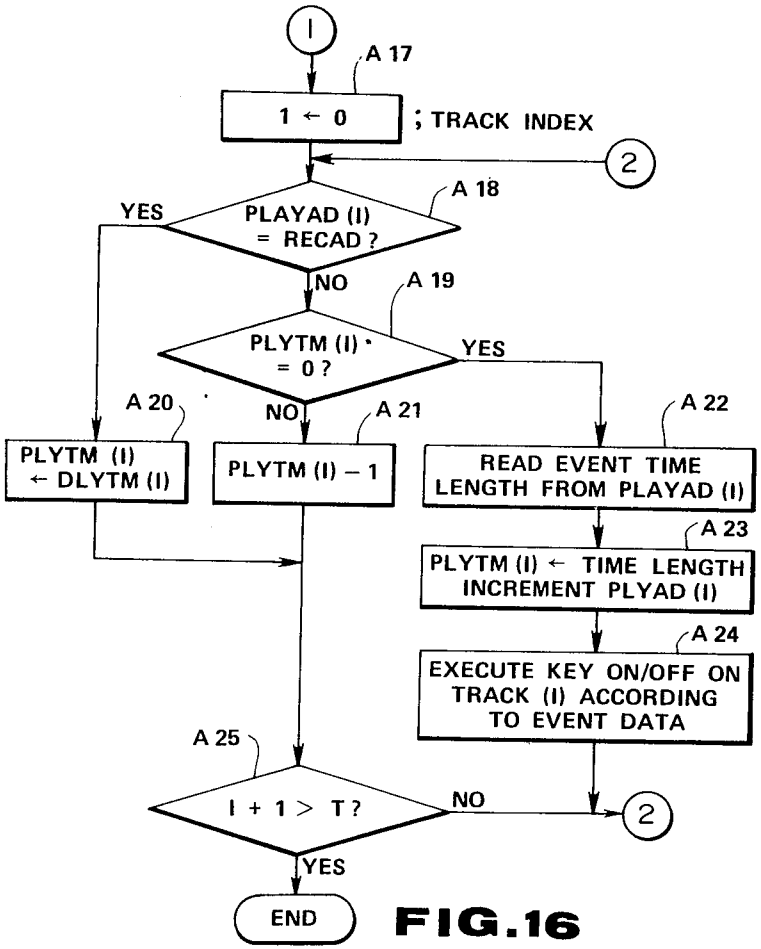
FIG. 16 is a flowchart for the remaining part of the sequence recording/playback.

FIGS. 15 to 17 illustrate flowcharts that CPU 23 executes for the recording/playback operation. The flows shown in FIGS. 15 and 16 are executed for every given time, and in accordance with these flows, CPU 23 performs a real time data recording in sequencer memory SQ and delay playback of data for 4 tracks at maximum from the memory SQ. The number of tracks in use is indicated by "T" (see step A16, for example). Recording time pointer RECTM is initialized to zero prior to the recording of the first performance event or at the time of recording a performance event (steps A1, A2 and A8), and it normally up-counts (step A3) to measure the time between two successive performance events (step A6). Playback time pointers PLYTM0 to PLYTMT store the values of the delay registers DLYTM for the associated tracks prior to the recording of the first performance event (steps A1, A18 and A20), and store time data representing the time between the present performance event and the next performance event after the present performance event is executed (step A22). The playback time pointers normally down-count (step A21) and it is the playback timing when these pointers become zero (step A17). The recording address pointer RECAD is set to the head address DSST of sequencer memory SQ either prior to the recording of the first embodiment or when its value exceeds the end address of sequencer memory SQ (steps A1 and A2; S2 and S3) and is incremented after data recording is executed. The individual playback address pointers PLYAD0 to PLYADT are set to the head address DSST of sequencer memory SQ until they reproduce the first performance event or when their values exceed the end address of the memory SQ (steps A1 and A2; S2 and S3), and are incremented upon each playback (step S23). The individual pointers PLYAD0-PLYADT and RECAD are also set back to the head address DSST when all the playback address pointers PLYAD0-PLYADT reach the position of recording address pointer RECAD and no more unexecuted playback event exists (steps A1 and A2; this flow should not necessarily be executed, though). When there exists no more processes to be executed for the individual playback tracks, playback time counters PLYTM0-PLYTMT of the tracks are set with the associated set delay values DLYTM (steps A18 and A20). Further, the flow includes the process for checking if recording address pointer RECAD approaches playback address pointers PLYAD0-PLYADT for the individual tracks, reading out the event time lengths from the pointers PLYAD0-PLYADT when RECAD approaches the pointers, adding the event time lengths to the value of playback time counters PLYTM0-PLYTMT, executing an unexecuted playback event that would be cleared in order to record a subsequent performance event when the key for that event is OFF, and incrementing playback address pointers PLYAD0-PLYAD7 (steps A10–A15). When the key for an unexecuted playback event is ON, that event is not reproduced for the following reasons. It is insignificant to execute an event whose proper playback timing is not reached, except for turning a key OFF for prevention of sound hold, and it takes time for performing velocity computation, key following or the like particularly in executing a key-ON event.

For descriptive simplicity, let us consider the case where there is one playback track, delay DLYTM is "3" and sequencer memory SQ has a capacity for four events. FIG. 18 exemplifies the performance sequence and playback sequence for this case, and FIGS. 19(A-)-19(D) illustrate the status of sequencer memory SQ in each processing stage and positions of playback and recording address pointers PLYAD and RECAD.

In process 1, as C2 is ON, the recording process as indicated by steps A6–A8 in the flows shown in FIGS. 15 and 16 is executed, and RECAD is shifted to a position for recording the second event (see FIG. 19A). In the flow of FIG. 16, PLYTM is decremented by one to become "2" (step A21).

In process 2, RECTM=1 (step A3) and PLYTM=1. Similarly, in process 3, RECTM=2 and PLYTM=0.

In process 4, as C2 is OFF, "3" (the value of RECTM resulting from step A3) is written in the time area for the first event as the time length until C2 has become OFF, the event of C2 being OFF is written in the code area for the second event, and RECAD is incremented to thereby reach the position where the third event is recorded. Since PLYTM=0 when the CPU enters the flow shown in FIG. 16, the playback process as indicated by steps A22–A24 are executed, a tone for C2 is generated, "3" is set in PLYTM as the hold time until execution of the C2-OFF event, and PLYTM is then decremented to be "2", thus incrementing PLYAD (see FIG. 19B).

In process 5, D2 is ON. The result is illustrated in FIG. 19C. "1" is the time between C2 becoming OFF and D2 becoming ON, and PLYTM=1 and RECTM=0. RECAD is shifted to the recording position for the fourth event.

In process 6, D2 being OFF is detected (steps A4 and A5) after RECTM=1 (step A3) the timer between the C2-OFF event and D2-ON event, "1" (=RECTM), is recorded (step A6) and the code for the D2-OFF event is also recorded at the position of RECAD (step A7). Subsequently, RECTM is set back to "0" RECAD is incremented (step A8). The increment process for RECAD is conducted as shown in FIG. 17, and RECAD for an event is incremented as by one event in step S1. In this case, the incremented result exceeds the end address of the sequencer memory and the condition set in step S2 is satisfied, so that RECAD is set back to the head address DSST in step S3. As a result, it is detected in step A10 that RECAD approaches PLYAD. In this example, RECAD is inhibited to fall within the range of one event from the position of PLYAD. In other words, PLYAD is separated from RECAD by a length of two events. After detection of PLYAD approaching RECAD in step A10, the necessary process is executed in the subsequent steps A11–A15. The time length data ("1") between one performance event (C2 being OFF in this case) and the next performance event (D2 being ON) is loaded by PLYAD and the loaded time data is added to the value of PLYTM. Consequently, PLYTM=2. Thereafter, PLYAD is incremented and the C2-OFF event is executed. As shown in FIG. 18, the C2-OFF event is executed earlier by a time of "1" and the subsequent event such as D2 being ON would be reproduced at the proper playback timing. Executing process 6 results in PLYTM=1 (step A21). FIG. 19D illustrates the operational sequence of process 6 on the sequencer memory.

In process 7, PLYTM=0, and in process 8 the D2-ON event is executed and PLYTM becomes "0" after "1" is loaded in PLYTM (loop from step A22 to A21).

In process 9, the D2-OFF event is executed.

The updating of the playback address pointer is conducted in the same flow as shown in FIG. 17.

What is claimed is:

1. An electronic musical instrument, comprising:

tone data output means for outputting tone data including at least pitch data corresponding to a manual performance;

tone generating means for generating musical tones based on said outputted tone data;

sequencer memory means for storing the tone data from said tone data outputting means;

recording address pointer means for incrementing an address of said sequencer memory means every time a recording access is performed to said sequencer memory means;

recording timer means for measuring time interval data of serially obtained tone data;

recording processing means for sequentially storing the tone data and the time interval data from the recording timer means at an address of the sequencer memory means pointed by said recording address pointer means;

playback address pointer means for incrementing an address of said sequencer memory means every time a playback access is performed to said sequencer memory means;

delay time storing means for storing predetermined delay time data; and sequence playback processing means for commencing to store the tone data and time interval data into said sequencer memory means by said recording processing means, and after a lapse of a time period corresponding to the delay time stored in said delay time storing means, for controlling said playback address pointer means to read out the tone data from said sequencer memory means for every time interval of said time data and to output the read out tone data to said tone generating means so as to generate a musical tone corresponding to the output tone data.

2. The musical instrument according to claim 1, further comprising means responsive to a determination that there remains no performance event to be executed by said sequence playback processing means, for setting back values of said recording address pointer means and said playback address pointer means to a position indicating a head address of said sequencer memory means.

3. An electronic musical instrument, comprising:

tone data output means for outputting tone data including at least pitch data corresponding to a manual performance;

tone generating means for generating musical tones based on said outputted tone data;

sequencer memory means for storing the tone data from said tone data outputting means;

recording address pointer means for incrementing an address of said sequencer memory means every time a recording access is performed to said sequencer memory means;

recording timer means for measuring time interval data of serially obtained tone data;

recording processing means for sequentially storing the tone data and the time interval data from the recording timer means at an address of the sequencer memory means pointed by said recording address pointer means;

playback address pointer means for incrementing an address of said sequencer memory means every time a playback access is performed to said sequencer memory means;

delay time storing means for storing a plurality of delay time data which are different from each other; and sequence playback processing means for commencing to store the tone data and time interval data into said sequencer memory means by said recording processing means, and after a lapse of a time period corresponding to a delay time stored in said delay time storing means, for controlling said playback address pointer means corresponding to the lapse of time of the delay time data to read out the tone data from said sequencer memory means for every time interval of said time data and to output the read out tone data to said tone generating means so as to generate a musical tone corresponding to the output tone data.

4. An electronic musical instrument according to claim 3, wherein said sequence playback processing means include means for respectively setting timbres of tones reproduced by a plurality of said playback address pointer means for each of said playback address pointer means.

5. An electronic musical instrument, comprising:

tone data output means for outputting tone data including at least pitch data corresponding to a manual performance;

tone generating means for generating musical tones based on said outputted tone data;

sequencer memory means for storing the tone data from said tone data outputting means;

recording address pointer means for incrementing an address of said sequencer memory means every time a recording access is performed to said sequencer memory means;

recording timer means for measuring time interval data of serially obtained tone data;

recording processing means for sequentially storing the tone data and the time interval data from the recording timer means at an address of the sequencer memory means pointed by said recording address pointer means;

playback address pointer means for incrementing an address of said sequencer memory means every time a playback access is performed to said sequencer memory means;

delay time storing means for storing predetermined delay time data; and sequence playback processing means for commencing to store the tone data and time interval data into said sequencer memory means by said recording processing means, and after a lapse of a time period corresponding to the delay time stored in said delay time storing means, for controlling said playback address pointer means to read out the tone data from said sequencer memory means for every time interval of said time data and to output the read out tone data to said tone generating means so as to generate a musical tone corresponding to the output tone data; and address pointer control means for controlling, when said recording address pointer means or said playback address pointer means become in excess of a final address of said sequencer memory means, to return a corresponding address pointer means to point representing a starting point of said sequencer memory means.

6. The musical instrument according to claim 5, wherein said address pointer control means forcibly increments said playback address pointer means when an address indicated by said recording address pointer means is within a given range with respect to an address indicated by said playback address pointer means.

7. The musical instrument according to claim 5, wherein when an address indicated by said recording address pointer means is within a given range with respect to an address indicated by said playback address pointer means, said address pointer control means causes said sequence playback processing means to forcibly execute a performance event stored at said address indicated by said playback address pointer means and then increments said playback address pointer means.

8. The musical instrument according to claim 7, wherein said sequence playback processing means forcibly executes said performance event only when said performance event is a key-OFF event.

9. The musical instrument according to claim 5, wherein:

said playback timer means is provided for detecting an elapse of said time interval; and when an address indicated by said recording address pointer means is within a given range with respect to an address indicated by said playback address pointer means, said address pointer control means forcibly increments said playback address pointer means and adds a time between performance events skipped by the forced increment thereof to that time for a next performance event which is being measured by said recording timer means.

* * * * *

UNITED STATES PATENT AND TRADEMARK OFFICE

CERTIFICATE OF CORRECTION

PATENT NO. : 4,901,616

DATED : February 20, 1990

INVENTOR(S) : MATSUBARA et al

It is certified that error appears in the above-identified patent and that said Letters Patent is hereby corrected as shown below:

On the title page, the name of the second inventor, "Takahashi Akutsu" should read --Takashi Akutsu--.

Signed and Sealed this

Twenty-sixth Day of March, 1991

*Attest:*

HARRY F. MANBECK, JR.

*Attesting Officer*

*Commissioner of Patents and Trademarks*